United States Patent [19]

Sonobe

[11] Patent Number: 4,636,022

[45] Date of Patent: Jan. 13, 1987

[54] CASSETTE CONNECTOR

[75] Inventor: Toshimitsu Sonobe, Tokyo, Japan

[73] Assignee: Thomas & Betts Corporation, Raritan, N.J.

[21] Appl. No.: 710,334

[22] Filed: Mar. 11, 1985

[51] Int. Cl.[4] ..... H01R 13/62

[52] U.S. Cl. ..... 339/75 MP; 339/176 MP

[58] Field of Search ..... 339/75 M, 75 MP, 176 MP, 339/91 R, 65

[56] References Cited

U.S. PATENT DOCUMENTS

| | | | |
|---|---|---|---|
| 2,925,592 | 2/1960 | Noyes | 340/366 |
| 3,366,919 | 1/1968 | Gammel, Sr. et al. | 339/176 |
| 3,701,071 | 10/1972 | Landman | 339/4 |
| 3,702,464 | 11/1972 | Castrucci | 340/173 |
| 3,789,345 | 1/1974 | Reimer et al. | 339/75 |
| 3,795,888 | 3/1974 | Nardo et al. | 339/176 |
| 3,848,952 | 11/1974 | Tighe, Jr. | 339/91 |
| 3,920,303 | 11/1975 | Pittman et al. | 339/91 |
| 3,942,854 | 3/1976 | Klein et al. | 339/17 |
| 3,997,226 | 12/1976 | Lang et al. | 339/17 |
| 4,084,874 | 4/1978 | Georgopulos | 339/75 |
| 4,095,791 | 6/1978 | Smith et al. | 273/85 |
| 4,128,289 | 12/1978 | Occhipinti | 339/75 MP |
| 4,136,917 | 1/1979 | Then et al. | 339/17 |
| 4,150,863 | 4/1979 | Krafthefer et al. | 339/17 |
| 4,159,541 | 6/1979 | Ward et al. | 365/233 |
| 4,185,882 | 1/1980 | Johnson | 339/176 MP |
| 4,216,522 | 8/1980 | Slagel et al. | 361/392 |
| 4,227,238 | 10/1980 | Saito | 361/415 |
| 4,388,010 | 6/1983 | Mott et al. | 400/69.2 |
| 4,426,122 | 1/1984 | Lainez et al. | 339/75 M |
| 4,468,075 | 8/1984 | Tamura et al. | 339/75 |
| 4,501,458 | 2/1985 | Cubbage | 339/65 |
| 4,566,079 | 1/1986 | Hasegawa et al. | 365/1 |

FOREIGN PATENT DOCUMENTS

| | | | |
|---|---|---|---|
| 2450594 | 4/1975 | Fed. Rep. of Germany . | |
| 2850378 | 5/1980 | Fed. Rep. of Germany . | |
| 2900438 | 7/1980 | Fed. Rep. of Germany . | |
| 146254 | 10/1977 | Japan . | |
| 2021334 | 11/1979 | United Kingdom | 339/75 MP |

OTHER PUBLICATIONS

Connectors and Interconnections Handbook, vol. 2, Connector Types, The Electronic Connector Study Group, Inc., pp. 4–15, 16, 1979.

Texas Instrument publication (Programmable TI-59), 2 pages.

*Primary Examiner*—John McQuade

*Attorney, Agent, or Firm*—Robert M. Rodrick; Salvatore J. Abbruzzese

[57] ABSTRACT

An electrical connector is provided for making electrical connection to a cassette having a plurality of exteriorly accessible terminals. The connector includes a housing having a cavity therein, the cavity being formed for oblique receipt of the cassette. Spring contacts are supported in the connector housing for making electrical engagement with the terminals of the cassette. A latching mechanism is established by cooperative engagement between a projecting pin on the cassette and a groove in the housing whereby pivotal movement of the cassette from its initial obliquely inserted position locks the cassette in the housing and establishes electrical connection between the terminals of the cassette and the contacts of the housing.

8 Claims, 12 Drawing Figures

CASSETTE CONNECTOR

FIELD OF THE INVENTION

The present invention relates to an electrical connector and, more particularly, to an electrical connector for connecting cassettes which are detachable therefrom.

BACKGROUND OF THE INVENTION

In an electronic musical instrument having a keyboard, for example, a memory cassette is provided which stores rhythm accompaniment data. A player may replace a rhythm cassette with another to select a desired rhythm.

A cassette and a connector therefor installed in such a musical instrument unit has structure for holding the cassette therein in addition to making an electrical connection therewith in the same manner as an electrical connection to a printed circuit board (PCB). When the cassette is repeatedly inserted to make engagement with the connector, incomplete electrical connections can often occur, thereby presenting problems.

SUMMARY OF THE INVENTION

The primary object of the present invention is to provide an electrical connector that overcomes the deficiencies of prior art devices.

In accordance with a more particular aspect of the present invention, a cassette and an electrical connector which may be in a musical instrument unit are joined independently of the electrical connection between terminals of the cassette and such connector in the musical instrument unit. As such, desirable electrical connections are provided even where the terminals of the cassette are frequently inserted in or detached from the connector, thereby eliminating the above-mentioned problems.

The present invention is described hereinafter with reference to an embodiment in conjunction with the accompanying drawings.

DETAILED DESCRIPTION OF THE PREFERRED EMBODIMENTS

Figure 1A:
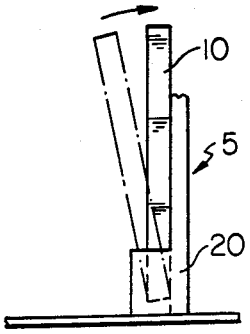
FIGS. 1A and 1B are side and front elevation views, respectively, showing a connected state between a connector and a cassette in accordance with a preferred embodiment of the invention.
Figure 1B:
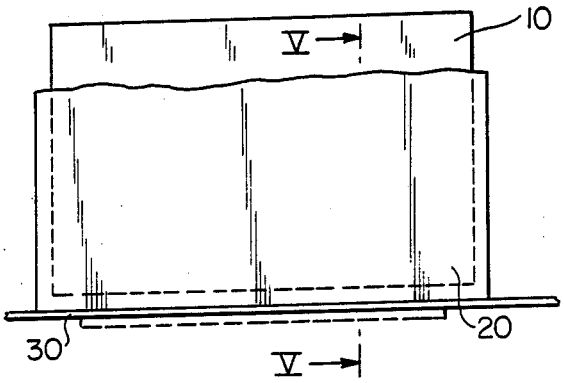

Referring now to the FIGS. 1A and 1B, a connector 5 comprises a housing 20 for detachably receiving and holding a cassette 10, the housing 20 being mounted on a printed circuit board 30. The cassette 10 is obliquely inserted in the housing 20 and is pivoted and locked in a manner to be described in detail. As used herein, the term cassette is intended to mean a package containing the storage of retrievable information and, which, in the preferred form, includes a plurality of individual electrical terminals that are exteriorly accessible and which interiorly are in electrical connection to devices containing the stored information. A connector for receipt of such a cassette 5 may be provided in a variety of devices, such as a musical instrument unit (not shown) that are adapted to be responsive to the data stored in such cassettes.

Figure 2:
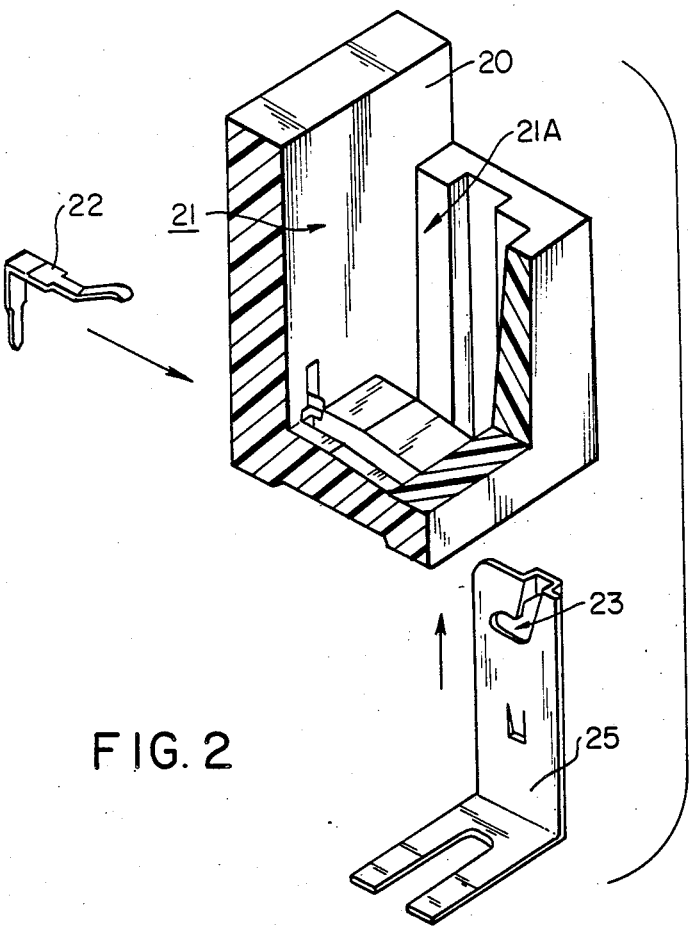
FIG. 2 is an exploded perspective view of the connector housing.

FIG. 2 is a cutaway exploded view of the housing 20 to illustrate the internal structure thereof. The housing 20 comprises, for example, a glass fiber reinforced resin or other suitable material. A cassette insertion port 21A of a hollow portion 21 has a width which is gradually increased outwardly from the bottom of portion 21. More particularly, the hollow portion 21 is formed to allow oblique insertion of the cassette 10 into the cassette insertion port 21A, (as shown in phantom in FIG. 1A). When the cassette 10 is pivoted to be substantially perpendicular (as shown in the solid lines in FIG. 1A) to the cassette insertion port 21A, a latch holds the cassette 10, as will be described.

An electrical contact 22 in the housing 20 comprises a leaf spring which is securely mounted in the bottom of the hollow portion 21. When the cassette 10 is mounted in the hollow portion 21, the contact 22 is brought into contact with a selected terminal 11 (FIG. 3) of the cassette, thereby making electrical connection therewith, as will be detailed. Reference numeral 25 denotes an L-shaped latch plate, the material of which is preferably a spring-like metal. The latch plate 25 has a slot 23 for receiving a latch pin of the cassette 10. The latch plate 25 is mounted on the side surface of the housing 20. The slot 23 has a guide function for guiding the cassette 10 into the housing 20 and a locking function for locking the latch pin. The slot 23 is generally L-shaped.

Figure 3:
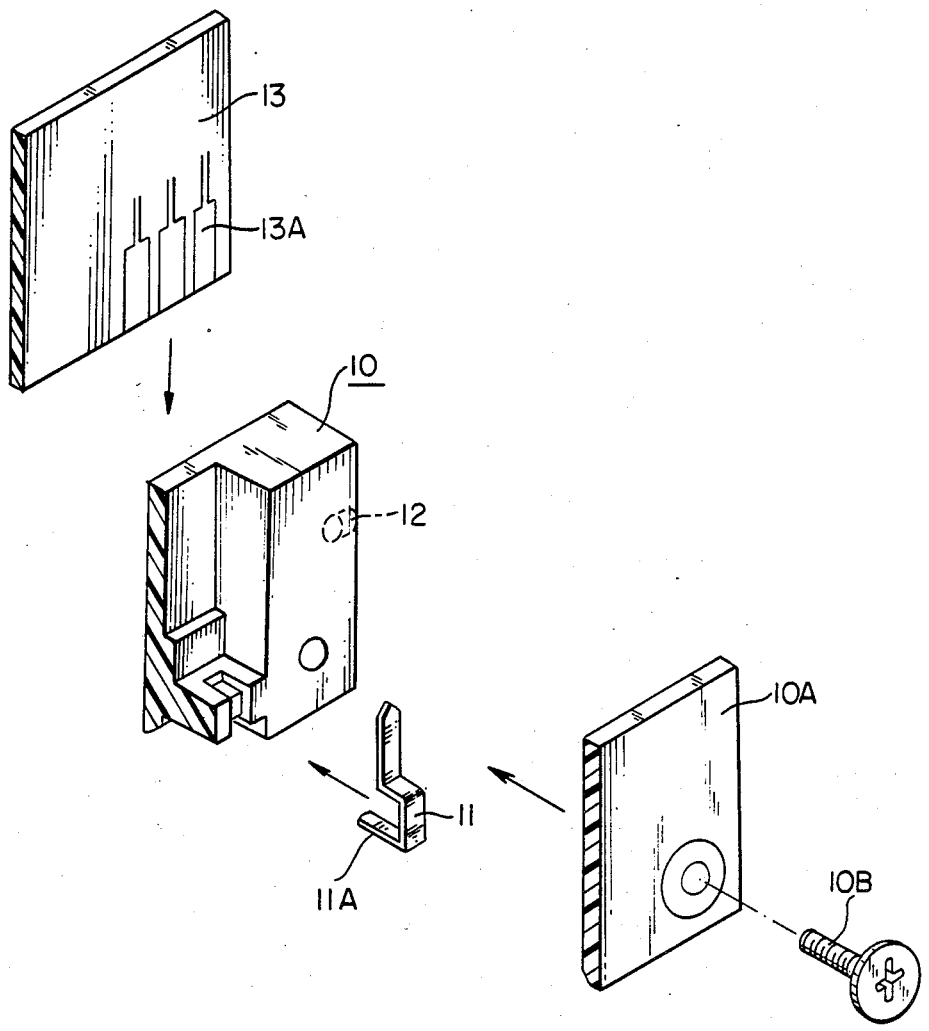
FIG. 3 is an exploded perspective view of a cassette package in accordance with a preferred arrangement.
Figure 5:
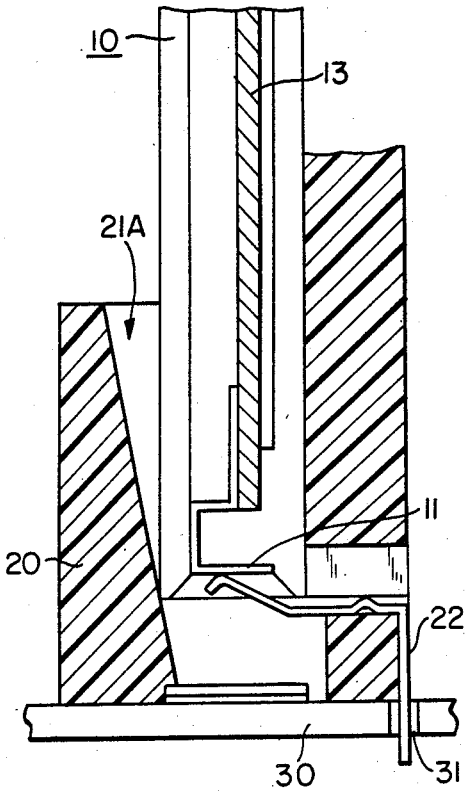
FIG. 5 is a sectional view as seen along the lines V—V of FIG. 2 showing a state wherein the cassette is mounted in the housing.

As illustrated in the exploded view of FIG. 3, a printed circuit board 13 is mounted to the cassette 10. Reference numerals 10A and 10B denote, respectively, a cassette cover and a screw for fastening the cassette cover 10A to the cassette housing 10. Each of the conductors 13A of the printed circuit board 13 is exposed exteriorly of the cassette so as to electrically connect to the corresponding terminal 11 (FIG. 5). Terminal 11 is supported in the cassette so as to have a portion **11*a* disposed for exterior access so as to allow for connection with housing contact 22 when the cassette and housing are joined. A latch pin 12 projects outwardly from an outer portion of the side surface of the cassette 10. The latch pin 12 holds the cassette in the housing 20 during insertion of the cassette into the housing 20**.

Figure 4:
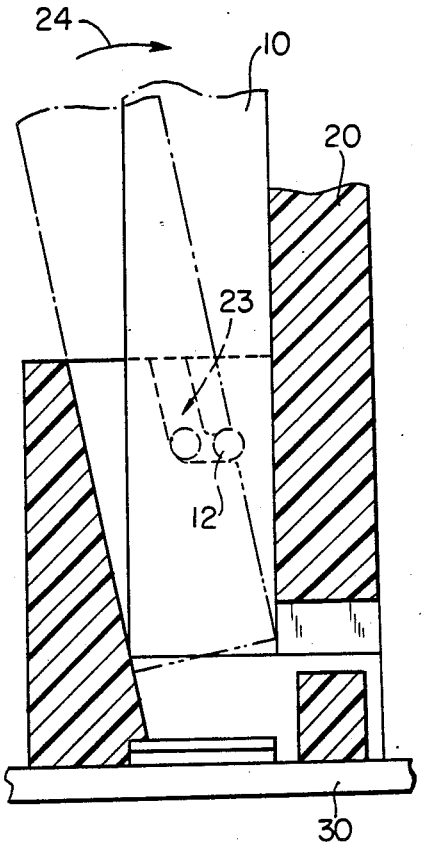
FIG. 4 is an illustration showing the connection procedures between the connector housing and the cassette.

As shown in FIG. 4, the cassette 10 is obliquely inserted into the housing 20 so that the latch pin 12 of the cassette 10 is engaged with the slot 23 of plate 25 supported by the housing 20. In this manner, the orientation of the cassette 10 is not determined by the inclination of the hollow portion 21, but rather by the guide (slot) 23. As such, when the cassette 10 is obliquely inserted into the housing 21 along the guide 23 and is pivoted in the direction as indicated by the arrow 24, the latch pin 12 is engaged initially with the top of slot 23, and then with continued insertion with the foot portion of the slot, thereby mounting the cassette 10 securely in the housing 20.

In FIG. 5 the contact 22 is shown mounted through the through aperture 31 of the printed circuit board 30 and is preferably soldered thereto.

Figure 6:
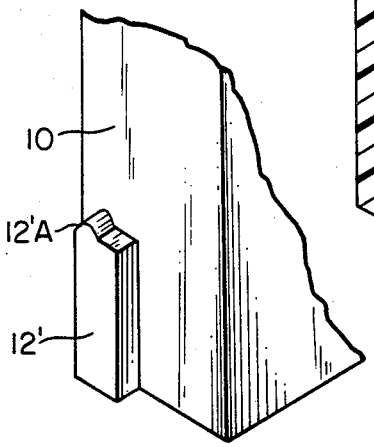
FIG. 6 is a partial cutaway perspective view of a cassette according to another embodiment of the present invention.
Figure 7:
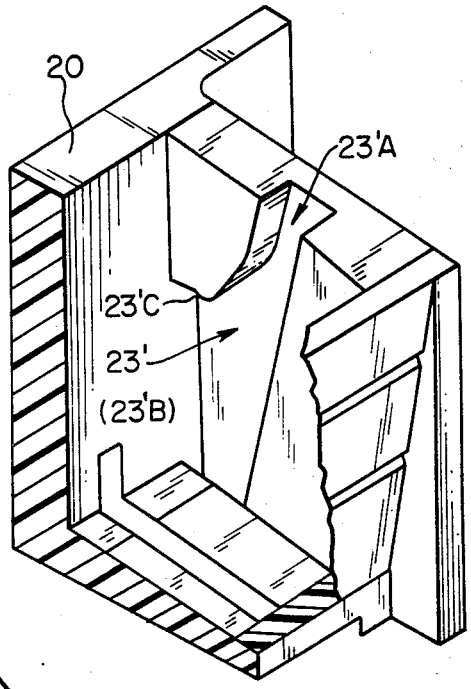
FIG. 7 is a partial cutaway view of the connector housing adapted to connect to the cassette of FIG. 6.

Another embodiment of the present invention is described with reference to FIGS. 6 to 8.

The latch means of this embodiment comprises a projection 12' formed on the side wall of the cassette 10, and a recess 23' formed in the inner wall surface of the hollow portion of the housing to engage with the projection 12'. The recess comprises a guide groove 23'A for guiding oblique insertion of the cassette into the insertion port and a locking groove 23'B for locking the projection when the cassette is pivoted to be perpendicular to the insertion port. Reference numeral 12'A in FIG. 6 and reference numeral 23'C in FIG. 7 denote engaging projections, respectively, each of which provide cooperative engagement between the projection and the locking groove.

Figure 8:
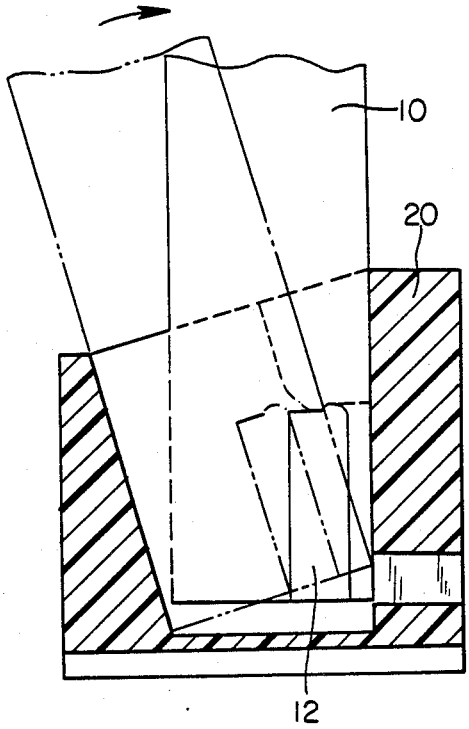
FIG. 8 is a sectional view showing a state wherein the cassette of FIG. 6 is mounted in the housing of FIG. 7.

FIG. 8 shows a state wherein the cassette 10 is mounted in the housing in accordance with this second embodiment.

Figure 11:
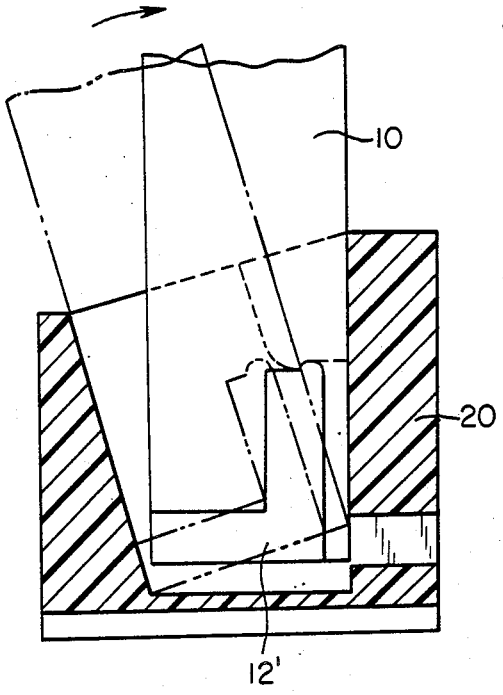
FIG. 11 is a sectional view showing a state wherein the cassette of FIG. 9 is mounted in the housing of FIG. 10.
Figure 9:
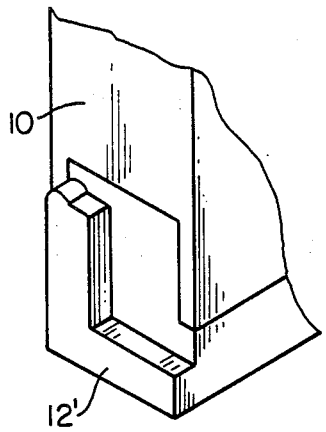
FIG. 9 is a partial cutaway perspective view of a cassette according to still another embodiment of the present invention.
Figure 10:
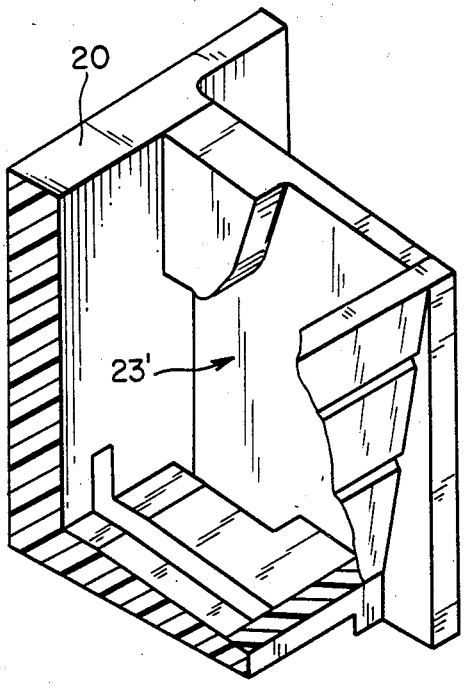
FIG. 10 is a partial cutaway perspective view of the connector housing adapted to connect to the cassette of FIG. 9.

FIGS. 9 to 11 show a third embodiment of the present invention. According to this embodiment with further reference to the second embodiment, the projection of the cassette is formed preferably in an L-shape, and the housing recess is enlarged to accommodate and engage with the L-shaped projection. FIG. 11 depicts a state wherein the cassette is mounted in the housing in this third embodiment. According to the third embodiment as compared with the first and second embodiments, the latching means (projection) of the cassette side and the latching means (groove) of the housing firmly mesh with each other so as to provide a polarization feature thereby preventing reverse side insertion of the cassette. As the cassette connector according to the present invention has the construction as described hereinabove, the following advantages are provided. Since the holding means mechanically holds the cassette and the housing together, the cassette need not be held by the means for electrically connecting the cassette and the housing. In addition, the cassette and the contact 22 of the housing are connected with each other through a leaf spring so as to withstand frequent connection operation of the cassette.

In order to mount the cassette in the housing, the cassette is obliquely inserted and is pivoted, so that the spring contact is brought into slidable contact with the cassette but not into point contact. In this sense, even if the cassette terminals become soiled or contaminated they can be cleaned through the sliding action, thus preventing poor connections.

Having described the preferred embodiments of the invention herein, it should be appreciated that various modifications may be made without departing from the contemplated scope of the invention. For example, it should be understood that while the connector in the preferred arrangement is adapted for connection to a cassette, the electrical connector of the present invention is not so restricted and may be used to make connections with other electrical components, such as printed circuit boards or the like. The true scope of the invention is set forth in the following claims.

What is claimed is:

1. In combination:

a cassette including a package having two major opposing walls and a bottom wall through which a plurality of electrical terminals are exteriorly accessible; and an electrical connector in secured receipt of said cassette, said connector including a housing having a cavity defined by a wider access opening than the bottom portion of said cavity, a plurality of spring contacts disposed in said housing cavity adjacent a bottom surface of said cavity and in electrical engagement with said cassette terminals, and engaging means maintaining said cassette and connector in retentive engagement, said engagement means including cooperative latching means on the cassette and connector housing that permits oblique insertion of said cassette into said housing in a first direction and retains said cassette in said housing in response to rotational movement of said cassette within said cavity, said terminals sliding on said spring contacts during said rotational movement of said cassette, said latching means comprising a ridge portion on said cassette and a recess portion of said housing cavity in receipt of said ridge portion, said cassette having opposing side walls connecting said two major opposing walls, and wherein said ridge portion includes a generally L-shaped projection extending outwardly from at least one of said side walls, a ridge for engagement with said housing within said recess being disposed on said L-shaped projection, said ridge being disposed adjacent the top portion of said L-shaped projection, said recess being sized to accommodate the foot portion of said L-shaped projection during insertion of said cassette into said housing cavity.

2. An electrical connector assembly comprising:

a cassette including a package having a plurality of exteriorly accessible electrical terminals and including a generally L-shaped projection extending outwardly from a portion of said package, a ridge being disposed adjacent the top portion of said L-shaped projection; and an electrical connector including a housing for secured receipt of said cassette, said housing having a cavity therein for receipt of said cassette and a plurality of electrical spring contacts disposed in said housing cavity and arranged therein to engage the terminals of said cassette upon insertion of said cassette therein, said housing having a recess (23') in an inside wall defining said cavity, said recess being sized to receivingly accommodate the foot portion of said L-shaped projection, said housing having a latching member for latchingly engaging said ridge on said L-shaped projection when said cassette is inserted on said connector.

3. An electrical connector assembly as claimed in claim 2, wherein said cavity has an opening which is gradually increased in dimension from the bottom of the cavity.

4. An electrical connector assembly as claimed in claim 2, wherein said cavity is shaped to receive said cassette obliquely into said cavity and wherein said latching engagement is effected upon movement of said cassette into a position generally perpendicular to said cavity.

5. An electrical connector assembly as claimed in claim 4, wherein said recess comprises a guide groove (23'A) for inserting the cassette obliquely into said cavity and a mate groove (23'B) for latching said ridge upon movement of said cassette into a position generally perpendicular to said cavity.

6. An electrical connector assembly comprising:

a cassette including a package having two major substantially parallel opposing walls spaced by a given spacing, a bottom wall extending transversely between said two major walls and a plurality of electrical terminals contained within said package that are exteriorly accessible through said bottom wall, and a latching element on said package; and an electrical connector for secured receipt of said cassette, said connector including a housing, a back surface, a front surface spaced from said back surface and a bottom surface, said back, front and bottom surfaces defining a cavity for receipt of said cassette, said front surface and said back surface converging toward each other and defining thereby an opening at the upper portion of said cavity that is wider than the given spacing of said cassette such that cassette may be inserted obliquely into said housing and defining at the lower portion of said cavity an opening that is narrower than said given spacing of said cassette such that the opposing major walls of said cassette will strike the front surface and back surface of said connector housing adjacent the bottom of said cavity, said connector further including a plurality of electrical spring contacts supported by said housing and extending into said cavity adjacent said housing bottom surface, a portion of each of said contacts lying upwardly of said narrower opening of said cavity, said contacts being arranged to respectively deflectably engage the terminals of said cassette when said cassette major walls strike said front and back housing surfaces, said housing including a latching member adapted to cooperatively latchingly engage said latching element on said cassette upon rotation of said cassette within said housing cavity on said electrical contacts from said initial oblique insertion position to a latching position.

7. An electrical connector assembly according to claim 6, wherein said back surface is substantially perpendicular to said bottom surface and said front surface is oblique relative to said bottom surface.

8. An electrical connector assembly according to claim 7, wherein said electrical contacts project cantileveredly into said cavity, said contacts being supported by said back surface.

* * * * *